United States Patent [19]

Leslie, Jr. et al.

[11] Patent Number: 4,700,391

[45] Date of Patent: Oct. 13, 1987

[54] METHOD AND APPARATUS FOR PITCH CONTROLLED VOICE SIGNAL PROCESSING

[75] Inventors: George F. Leslie, Jr., San Francisco; Kent W. MacKay, San Bruno, both of Calif.

[73] Assignee: The Variable Speech Control Company ("VSC"), Burlingame, Calif.

[21] Appl. No.: 935,604

[22] Filed: Dec. 1, 1986

Related U.S. Application Data

[63] Continuation of Ser. No. 500,632, Jun. 3, 1983, abandoned.

[51] Int. Cl.[4] ..... G10L 5/00

[52] U.S. Cl. ..... 381/35; 364/513.5

[58] Field of Search ..... 381/29-34; 364/513.5

[56] References Cited

U.S. PATENT DOCUMENTS

| | | | |
|---|---|---|---|
| 3,104,284 | 9/1983 | French et al. . | |
| 3,816,664 | 6/1974 | Koch | 381/32 |
| 4,020,291 | 4/1977 | Kitamura et al. . | |
| 4,121,058 | 10/1978 | Jusko et al. . | |
| 4,464,784 | 8/1984 | Agnello | 381/34 |

FOREIGN PATENT DOCUMENTS

| | | |
|---|---|---|
| 1415553 | 5/1964 | France . |
| 2098032 | 3/1982 | United Kingdom . |

OTHER PUBLICATIONS

The Journal of the Acoustical Society of America, vol. 41, No. 1, 1967, pp. 60-65, New York, US; R. J. Scott, "Timing Adjustment in Speech Synthesis". * Paragraph I, Time Adjustment According to Fundamental Voice Periods*.

Journal of the Audio engineering Society, vol. 23, No. 9, Nov. 1975, pp. 713-721, New York, US; I. M. Bennett et al.: "A Study of Time-Domain Speech Compression by Means of a New Analog Speech Processor"*p. 714, Basic concepts of the sample, discard, abut (SDA) method*.

The Journal of the Acoustical Society of America, vol. 63, No. 2, Feb. 1978, pp. 624-625, New York, US; E. P. Neuburg; "Simple Pitch-Dependent Algorithm for High-Quality Speech Rate Changing", *p. 625, left--hand column, lines 2-15*.

Frequenz, vol. 35, No. 10, Oct. 1981, pp. 265-270, Berlin, DE; H. Ney: "Bestimmung der Zeitverlaufe von Intensitat und Grundperiode der Sprache für die automatische Sprechererkennung", *p. 268, right-hand column, line 45-p. 269, left-hand column, line 13*.

Ian Bennet, "A Study of Speech Compression Using Analog Time Domain Sampling Techniques", Stanford University Doctoral Dissertation in Dept. of Electrical Engineering, May, 1975, (Chapters IV, V & IV).

Edward P. Neuburg, "Simple Pitch-Dependent Algorithm for High-Quality Speech Rate Changing", J. Accoust. Soc. Am., 63(2), Feb. 1978.

Francis F. Lee, "Time Compression and Expansion of Speech by the Sampling Method", Journal of the Audio Engineering Society, Nov. 1972.

*Primary Examiner*—E. S. Matt Kemeny

*Attorney, Agent, or Firm*—Charles E. Pfund

[57] ABSTRACT

Digital processing of speech signals for compression-/expansion pitch change is provided by writing and reading a ROM at different rates and controlling the discard/repeat segments of memory to be integral multiples of the pitch period. The rear pointer jumps a portion of the memory to either skip a portion (in compression) or retrace a portion (in expansion) of the recorded information. The read pointer jumps so as to avoid crossing the write pointer (thereby avoiding reading old recorded information). The jump occurs when a predetermined spacing or condition is reached between read and write pointers.

19 Claims, 10 Drawing Figures

METHOD AND APPARATUS FOR PITCH CONTROLLED VOICE SIGNAL PROCESSING

This is a continuation of co-pending application Ser. No. 500,632, filed on June 3, 1983, now abandoned.

This invention relates to digital voice signal processing to obtain pitch changing which processing is controlled by the pitch period of the voice signal being processed.

BACKGROUND OF THE INVENTION

The usefulness of an economical system for real time pitch changing of an audio signal or for speech compression and/or expansion (that is, pitch restoration of the audio signal generated by speeded or slowed playback of a recording) is well recognized today. The early forms of such systems were electromechanical tape players with moving magnetic read heads. These systems produced the equivalent of cutting the record tape into short segments and splicing alternate segments together. These early schemes have been replaced by all-electronic systems such as those described in Schiffman patents U.S. Pat. No. 3,786,195 and U.S. Pat. No. 3,936,610 which have been widely used commercially.

The Schiffman approach and most other practical systems relay on a pitch change-splice approach. That is, in the case of audio pitch lowering, regular segments of the signal are stretched to achieve pitch change and the intervening remainders are deleted resulting in discontinuities created by the deletion. In the case of audio pitch raising, the repetitive pitch change consists of compressing the time interval occupied by the signal segments thus creating gaps; the comressed segments are then repeated as necessary to fill the gaps created by the compressing of the signal.

Continual work has been done on improving the sound quality of the "pitch change-splice" methods, mostly centered on improving the splicing scheme. The suggested approaches usually involved a rather microscopic analysis of the waveform at splice points, the splice points having generally been predetermined by system constraints regardless of the instantaneous or general characteristics of the waveform being processed. That is, focus has been on the instantaneous values of waveform parameters (such as level, slope, and/or direction (polarity) of slope) and on matching, in respect to one or more of those values, the trailing edge of the segment to be terminated with the leading edge of the segment to be next connected. Zero crossing splicing (with and without coincidence of polarity), level matching, overlap schemes and others have been tried, but the improvement in sound quality generally was less than expected.

One example of a digital zero energy level matching scheme is found in the patent to Lee U.S. Pat. No. 3,803,363, where audio signals were converted into digital format and stored in random access memory and read out at a different rate than that at which they were written in memory. When the addresses at which memory access for write and read are taking place came close to converging (which occurred because the write and read were different), the scheme provided for jumping to a new address which was selected to have a low energy level or "zero crossing".

Another digital scheme which provided for write and read at different rates in the digital memory conditioned the jump when the addresses converged on examining the signal in storage to delay the jump till a suitable match between the waveforms was located. This patent to Jusko et al., U.S. Pat. No. 4,121,058, provided additional features such as looping for review of specific portions of the message and interrupting the input storage in order to hold the segment under review in memory.

In each of the foregoing digital schemes of Lee and Jusko et al., the jump of the read pointer to its new address in memory is preselected to utilize substantially all of the memory capacity such that the initial differential between the write and read pointers is constant except for the small variation occasioned by the microscopic examination and adjustment made to provide a signal level match.

Research such as that done by Ian Bennet has shown that in the case where the audio signal is speech, if the signal segments which are stretched or compressed by the processing circuit are synchronous pitch periods of the fundamental voiced frequency there is significant improvement in the sound quality of the processed audio. (Note that if the fundamental voice frequency is extracted and examined, then the pitch period is simply the period of that fundamental.) The complete (unfiltered) speed waveform, however, is not a pure sinusoid, even for voiced sounds, but rather a repetitive pattern each period of which generally begins with a glottal pulse followed by a damped waveform over the remainder of the epoch. Some schemes for pitch synchronous processing have been described, but they generally became quite elaborate and complicated because they require detection of the beginning of epochs (i.e. the glottal pulse) and processing by discarding or repeating one or more integral epochs.

Neuberg has suggested a new version of the original cut and splice method. Neuberg has proposed that for pitch lowering, the deletion (or in the case of pitch-raising, the repetition) of segments equal in length to an epoch, but regardless of where they started or ended, would produce good results.

This was explained in terms of speech characteristics where, for many voiced sounds, successive epochs contain a repetition of almost identical waveforms of the same pitch period which may continue for many such pitch periods. Thus, deletion of any segment equal in length to the pitch period maintains the cadence of the pitch periods. This approach was stated as leading to a major improvement, which could not result from splicing techniques which focus solely on "microscopic" matching of waveform parameters, and could in theory at least be accomplished more readily and simply than true pitch synchronous systems. Moreover, this approach automatically results in a fair degree of wave matching in the "microscopic" sense, since to the extent that the pitch period and waveform do not change from epoch to epoch, the end of one segment and the beginning of another (with one or two pitch periods deleted in between) will often match closely in regard to level, slope, etc.

SUMMARY OF THE PRESENT INVENTION

The present invention provides an improved version of the pitch change cut and splice systems in which the discard intervals or the repetition intervals for gap filling in compression and expansion respectively are controlled in accordance with a glottal pulse signal derived from the actual speech signal such that the benefits of the natural splicing of epochs can be realized in a system which can process tape recorded material at selectable playback speeds or in a system for real-time pitch shifting and which can be readily produced in high volume at low cost. This result is achieved by conventional microprocessor logic application with fixed programming to perform the necessary audio sampling, data conversion, storage and read out, together with analysis of the audio signal to derive the glottal pulse signal whose periodicity is used to control the jump interval in memory, which is required when the write and read pointers converge in either compression or expansion mode. Various modifications include limit circuits to operate in absence of voiced speech sounds and the utilization of a second read pointer closely associated with the position of the write pointer so that particulatrly in the case of compression the pitch period deletion is accurately related to the audio signal currently being read from memory rather than being spaced by the depth of memory as is the case when the pitch period calculation is derived from the audio input signal (i.e. that provided to the write pointer.)

DESCRIPTION OF THE INVENTION

Figure 1:
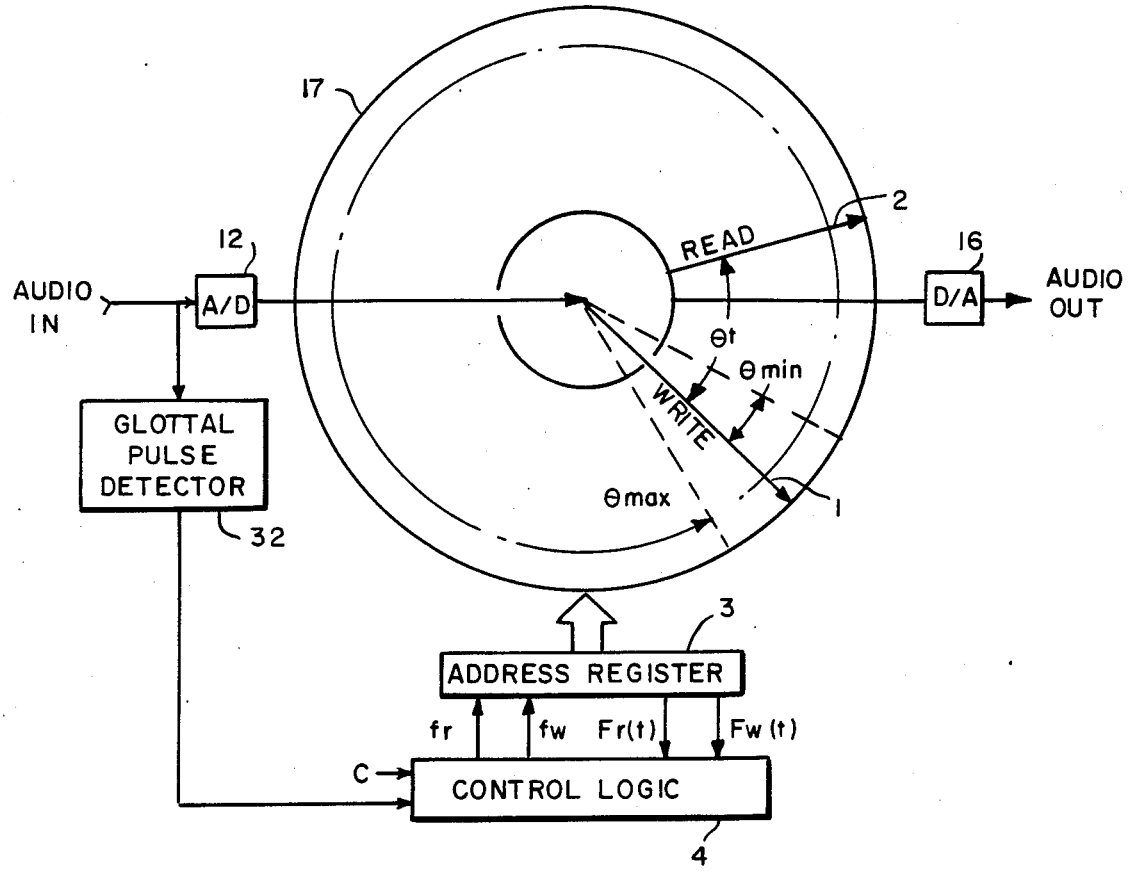
FIG. 1 is a conceptual block diagram of the overall system in accordance with the invention.

Referring now to FIG. 1 the overall arrangement utilizes a random access memory RAM 17 which receives the digitized samples of the audio input signal from an analog to digital converter 12 which digital words are written in memory sequentially by a write pointer 1. The memory is read out in the same sequence by a read pointer 2 and such digital words read from memory are converted in a digital to analog converter 16 to provide the audio output.

The memory is under control of an address register 3 which is operated by control logic 4.

Control logic 4 supplies a read rate signal $f_r$ which is fixed and write rate signal $f_w$ which is equal to $cf_r$ where c is the compression ratio defined as unity for no pitch change and reproduction at the recorded rate and as a quantity greater than 1 for compression and less than 1 but greater than zero for expansion. The present addresses of the write and read pointers are used by control logic 4 to develop the operational control of the system. The difference between the present address locations indicated by the quantities $F_r$ (t) and $F_w$ (t) represents the angle $\phi_t$ which in the representation of FIG. 1 is the angular spacing between the write and the read pointers 1 and 2. Also indicated in FIG. 1 are the quantities $\theta_{min}$ and $\theta_{max}$ defining a sector on opposite sides of the write pointer 1. When the angle $\theta_t$ reaches a value such that the read pointer is less than $\theta_{min}$ or greater than $\theta_{max}$ the condition for jumping the read pointer to a new location has arrived and it is the control for this operation that constitutes the major decisional criteria of this invention.

The jump distance for the write pointer in accordance with the invention is always an integral number of pitch periods, but not pitch period synchronous. In other words, the jump does not need to be synchronized at the glottal pulse but the period between glottal pulses is necessary to determine the magnitude of the jump along with other significant factors which determine the number of pulse periods the jump should be. For this purpose a glottal pulse detector 32 develops a pulse signal output that is supplied to control logic 4 for this purpose.

Figure 2:
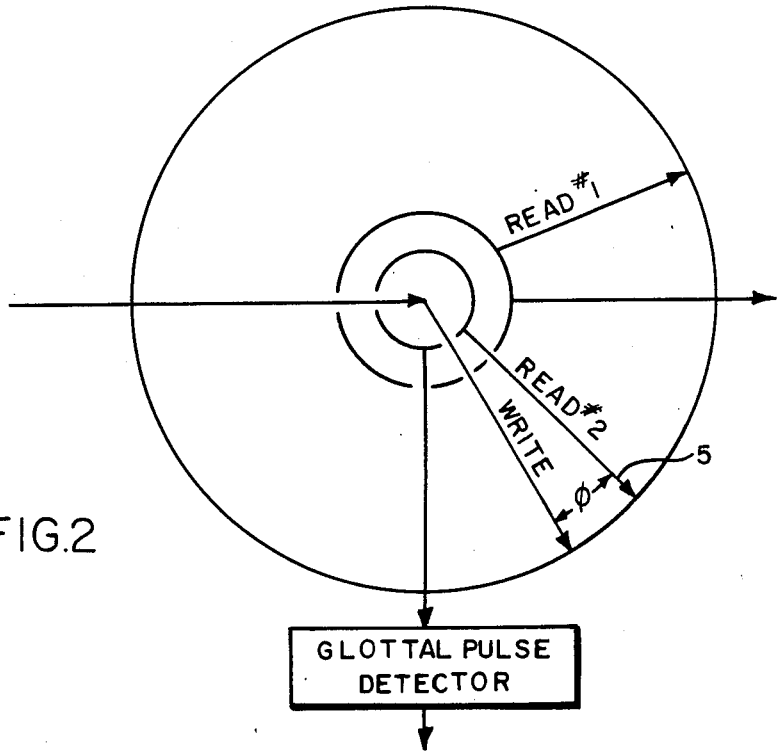
FIG. 2 is a diagram showing a modification of the ROM memory with two read pointers.

Referring to FIG. 2, the arrangement of FIG. 1 has been modified by adding a second read pointer 5 which moves at the speed of write pointer 1 with a fixed spacing therefrom represented by the angle $\phi$. The other modification shown in FIG. 2 is that the source of the audio signal is derived from the digitized audio input signal at the location of the second read pointer 5. This feature, as will be described, assures that a current value of glottal pulse period will be utilized by the system.

Figures 3A, 3B, 3C:
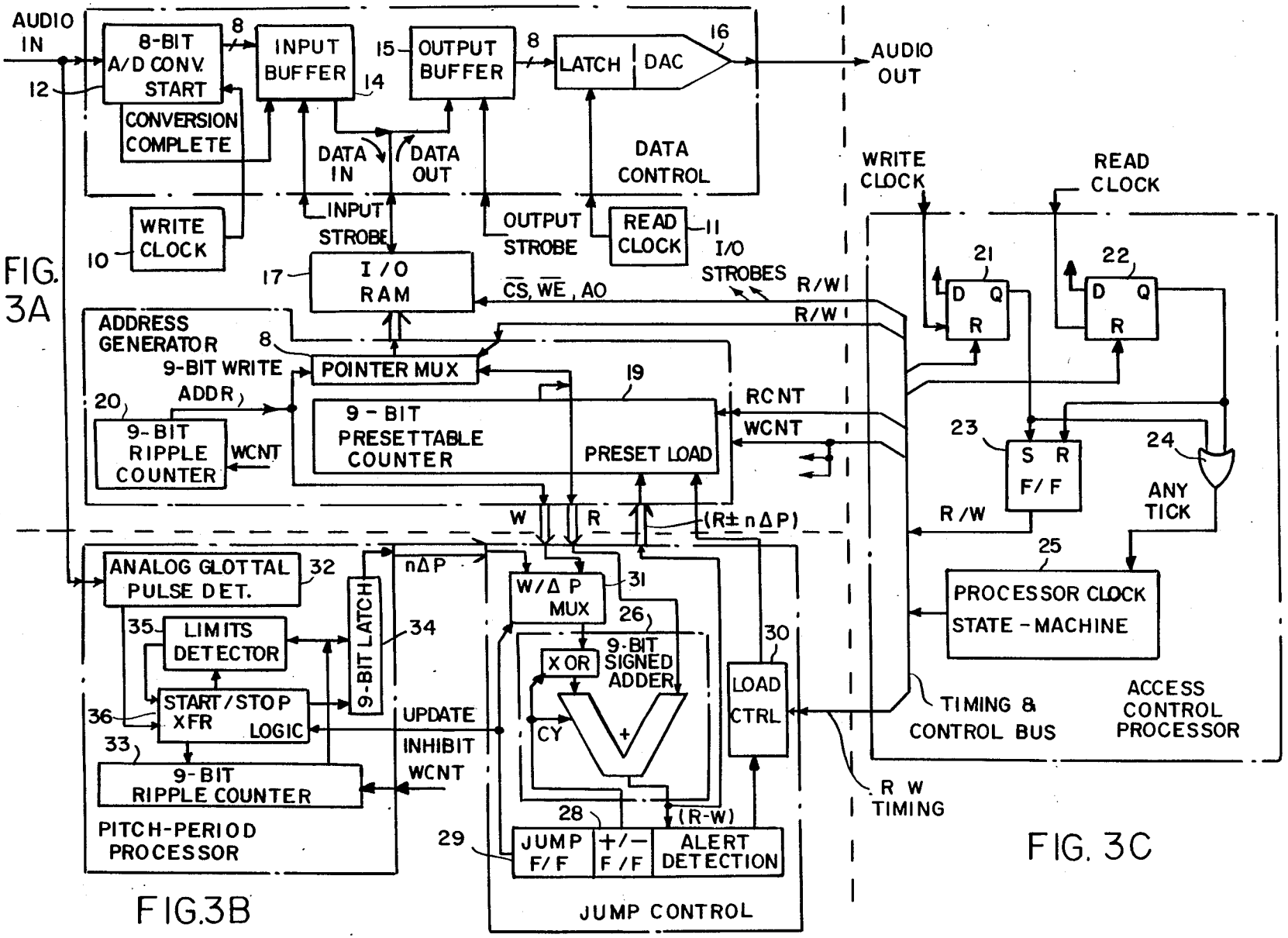
FIGS. 3A, B and C, assembled as indicated, provide an overall block diagram of the basic system.

Referring now to FIGS. 3A, 3B and 3C the architectural overview of a specific preferred embodiment digital system will be first described.

The structure of this embodiment is divided into five functional blocks: Data Control, Address Generator, Access Control Processor, Jump Control, and Pitch Period Processor. These five elements, working in concert, control the data flow in a conventional digital Random Access memory (RAM) 17, which is addressed sequentially in a continuous loop, and which provides the necessary short-term memory.

The functions of the above-identified blocks are:

Data Control

Provides the digitized data interface for the analog audio in and audio out.

Address Generator

Provides multiple addresses for the RAM, which include an address for the next input and an address for next output.

Access Control Processor

Provides the timing signals necessary for the orderly read/write of the RAM.

Jump Control

Provides part of the "smart FIFO" intelligence at the output side.

Determines the "when" and the "which" for discard or gapfill. It also permits a "look-ahead" Read-out for the Pitch Period Processor.

Pitch Period Processor

Determines the "how Much" for the Jump Control module. Working on the audio input signal, determines a current measure of the periodicity of the speech waveform.

Data Control

Data Control is a straight-forward treatment for handling sampled data.

WRITE CLOCK is a regular signal with a frequency in direct proportion to the tape speed or other control voltage thus introducing the compression ratio, C, to control pitch change. It determines how often and how the input data is digitized. For a 1:1 compression ratio (C=1), it has the same frequency as READ CLOCK 11. A Nyquist sampling rate of 12.5 KHz for C=1 permits an audio bandwidth of 6 KHz.

Maximum compression is specified at 2.5:1, so the maximum frequency of WRITE CLOCK is 31.25 KHz and the Analog-to-Digital converter 12 must be operated in 32 s for each sample.

The digitized data word has been established at 8-bits per sample, however the A/D converter 12 and a digital to analog converter 16 are not necessarily restricted to be of the linear type, and may embody companding techniques to maximize the dynamic range of the established 8-bit data path.

An Input Buffer 14 is for the general case of an analog-to-digital conversion that consumes a considerable portion of the available processing time. This element comprises a "mail-box" so that Data Control and Access Control need not wait upon one another. The Input Buffer 14 may not be required if the A/D converter is sufficiently fast to be idle when Access Control requires new data.

It is noted that an INPUT STROBE and an OUTPUT STROBE from Access Control operate buffers 14 and 15 but need not be necessarily regular. But in order to ensure regular sampling, the input sample should be in a fixed phase relationship with the WRITE CLOCK. Likewise, the output sample should be allowed to change only in a fixed phase relationship with the READ CLOCK. The input Buffer 14 and the Output Buffer 15 provide this function.

Address Generator

The depth of RAM 17 has been establisehd at 512, 8-bit samples. Thus, a 9-bit address is required for each access to the RAM.

A 9-bit sequential counter provides the RAM WRITE ADDRESS for the input sample. To allow for the simplest physical realization for this counter, the counter is advanced under command of the signal WCNT, which may be the last item in the WRITE process flowchart (FIG. 4A), allowing nearly the full period of the WRITE CLOCK for its next address to settle.

A 9-bit presettable counter 19 provides the READ ADDRESS and the non-sequential "intelligent" access to the output sample. It is under command of a combination of timing signals from Access Control and Jump Control.

Either one of these two counter outputs is routed at different times to the RAM through the 9-bit parallel multiplexer called POINTER MUX 18.

Access Control Processor

This functional block provides the detailed timing and decision logic for any and all access to data in the RAM 17. It is a single processor controlled by a processor clock 25 and time-shared by the two asynchronous processes READ and WRITE. Its function and its structure are not unlike the interrupt mechanism of a mini/microcomputer.

Figure 4A:
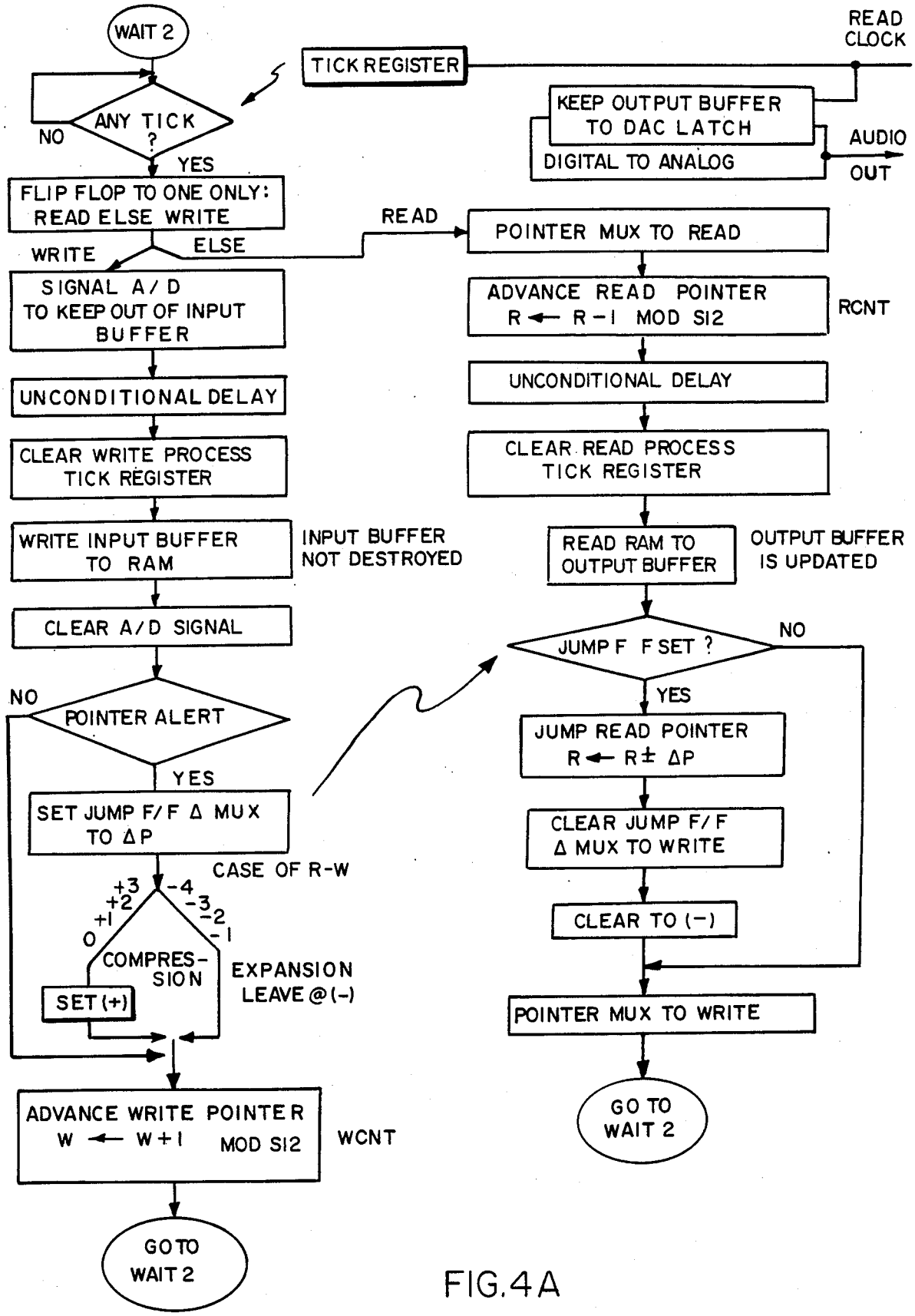
FIG. 4A is a flow chart showing programming for control of the write and read pointers and the output buffer for the digital to analog converter.

Referring to the FLOWCHART, FIG. 4A, the idle state of the ACCESS CONTROL processor is denoted by the terminator WAIT 2. The processor is awaiting a service request from either the READ CLOCK or the WRITE CLOCK, or both simultaneously.

If a service request occurs in isolation, a hardware flip/flop 23 is set to the appropriate condition corresponding to the process to be serviced, either READ or WRITE.

If service requests occur in coincidence the hardware flip/flop 23 must make a "fielder's choice", choosing just one process for service (the RAM can handle only one at a time). Whichever process is serviced is the one that is acknowledged. Acknowledgement consists of clearing the appropriate request and reseting of the hardware device that initiated the process. These devices are termed "TICK REGISTERS" 21 and 22 and may be realized by almost any simple one-bit memory device. Their function is to provide one and only one service request for each period of the CLOCK (WRITE or READ) with which they are associated. Because they have memory, they also serve as a "mail-box" between their CLOCK and the ACCESS CONTROL PROCESSOR. Thus if ACCESS CONTROL is busy with a WRITE process when READ CLOCK requests new service, that request will still be waiting when the processor returns to "WAIT".

It should be noted that there is no particular ordered priority on the service of READ or WRITE. The logic is purposely kept as simple as possible and JUMP CONTROL is aware of this simplicity.

Jump Control

JUMP CONTROL is not a separate processor. It is a collection of combinational logic that provides the arithmetic computation for producing a non-sequential (JUMP) next address for output access. It is under control of the ACCESS CONTROL processor and contains a minimum of control memory for coordinating its function under the two processes of READ and WRITE.

Refer to the FLOWCHART, FIG. 4A, DIGITAL. At each and every WRITE access of RAM, the W/ΔP MUX 31 (called "ΔMUX" in the FLOWCHART) is set to "W" and (+/−) is set to (−). This permits the signed adder 26 to make a comparison of the WRITE POINTER and the READ POINTER. If logic decides to make a JUMP the READ pointer is moved (forward or back) by nΔP where ΔP is the pitch period and n is an integer.

ALERT DETECTION 27 examines the output of the signed adder and saves the decision in a JUMP Flip/Flop 29.

The JUMP decision is different depending upon whether the system is set for COMPRESSION or EXPANSION. The details are shown in the FLOWCHART. The case of COMPRESSION or EXPANSION is determined by the +/− FLIP FLOP 28 which compares the sign of the difference quantity R-W. This evaluation is equivalent to determining whether to WRITE pointer has moved to within-MIN or MAX of the READ pointer.

PITCH PERIOD PROCESSOR

This module measures the glottal pulse period and provides a constant access value of n P for the magnitude of the jump.

OVERALL DESCRIPTION AND OPERATION

The central memory is a RAM 17, and the RAM requires an address and it delivers data, or it accepts data. Data Control treats the data, either in or out depending on whether it is writing or reading. Writing is at a certain address, which is provided by the write counter, and reading is from a read address. The two addresses have to be combined in a multiplexer POINTER MUX 18 in order to deliver a single address to the RAM because the program can only access the RAM, either read or write, but not both at the same time. An access control process coordinates the reading and the writing so that they are distinct. That processor is driven by asynchronous signals, i.e. the write clock and the read clock do not have to have any phase fixed relationship whatsovever.

The selection of write or read is made by a flip flop 23's being held in an undefined state, where both its outputs are not distinct. When either the write clock is recognized or the read clock is recognized, or both, then the flip flop 23 is released to flop into one of its defined states to select one or the other, read or write.

The WRITE and READ clocks are periodic. The leading edge of the write clock is detected by flip flop 21 and the leading edge of the read clock is being detected by flip flop 22 (TICK REGISTERS). Their Q outputs feed the set/reset inputs of a WRITE/READ flip flop 23, so the rising edge of clock will trigger the flip flop to make an decision to go to read or write. If there is no request, in other words after new business is completed, then the input flip flops (the tick registers) are reset, so that there is a low on the set side and a low on the reset side of the read/write flip flop 23, and it is in a condition of so-called undefined state of its outputs, it really has not made a decision, as soon as either one or the other of the sets is released, then it will take up one or the other of the defined states. That causes it to select either the READ or the WRITE. This is like the so-called "fielder's choice," where the READ/WRITE flip flop is the fielder and has to serve both processes, the WRITE process and the READ process. If both come in at the same time it makes a fielder's choice. The process is so short that as soon as one is completed the other process will be acknowledged and serviced.

The PROCESSOR CLOCK STATE MACHINE (PCSM) determines the individual ordering of the data packages that go into the RAM, because the RAM has four input/outputs—four bits—requiring two writes to write one 8-bit data piece into the RAM. Likewise there are two processes to retrieve two 4-bit packages, two 4-bit nibbles, that are combined into one 8-bit output word.

The PCSM 25 provides a three-step function. It provides an initial delay, so that any process that had preceded the new process will have time to settle out. Then it allows one 4-bit nibble to happen, and finally a second 4-bit nibble which completes the process. Sometime during that process, because the access control processor knows what function it is performing—i.e. either read or write, but never the two simultaneously—it acknowledges the one that it is doing. It resets either 21 if 21 started it or 22 if 22 started it, but it does not acknowledge the other one. In short, when it has finished an operation, it acknowledges the one it did. If the operation that it was not doing is set in the meantime, it is immediately ready to perform that, immediately after the preceding one.

The PCSM 25 has an asynchronous clock that can be started by either the write clock or the read clock transition of flip flops 21 or 22. When both are finished, the PCSM is set into its idle condition and no longer clocks. For each write clock transition and for each read clock transition there is guaranteed to be one and only one cycle of the PCSM.

The 9-bit ripple counter 20 is maintaining the write address in a simple sequential fashion, one address after another, and after 512 addresses it returns to address 0. There is no reset for that counter. It simply produces a 9-bit address that rolls over by itself. On the other hand the read counter 19 is a presettable counter which can be commanded to assume any desired preset number. That number is obtained from JUMP CONTROL as $R \pm n\Delta P$, a 9-bit address for the preset of counter 19. The command to accept that preset is recognized by counter 19 when the LOAD CONTROL 30 is asserted and R count RCNT has a leading edge. The load control in JUMP CONTROL provides the steering signal for counter 19 and is part of the read write/timing provided by the ACCESS CONTROL PROCESSOR. If the signal PRESET LOAD is asserted prior to an R count, the $R \pm n$ P preset is loaded into the presettable counter 19. That constitutes a jump.

Until the time that the jump is necessary the 9-bit presettable counter is operated in very much the same manner as the counter 20. It runs under command of the R count signal RCNT which comes from the access control processor, so that prior to any read the counter 19 is incremented one address location. The ACCESS CONTROL PROCESSOR provides as its first order of business a delay time to allow the 9-bit presettable counter 19 time for its addresses to settle, and they must settle through the pointer MUX 18 into the RAM 17 prior to the data being strobed according to the DATA CONTROL TIMING.

The RAM output is allowed to assume its new analog value only on the leading edge of the signal from read clock number 11, so an output buffer 15 is provided that buffers during the time while the RAM is read out and during the time while that data has to be delivered to the output.

The JUMP CONTROL determines the interval as an integral number of pitch periods, n P. The PITCH PERIOD PROCESSOR, in a manner which will be described later, determines what that number is, and puts it on a bus we call the $n\Delta P$ bus. A 9-bit number is thus continuously available on the $n\Delta P$ bus to determine the magnitude of the jump whenever a jump is needed. In the case of compression it must be a jump ahead into higher memory, in the case of expansion it must be a jump back into earlier memory, so the cases of $R+n\Delta P$ and $R-n\Delta P$ provide respectively for compression and expansion. In order to accomplish this jump, a 9-bit signed adder 26 adds the current address from the presettable counter 19 to the $n\Delta P$ number and provides a new address number at the $R \pm n\Delta P$ bus, for use when a jump is required. A multiplexer 31 $w/\Delta P$ MUX, allows same 9-bit signed adder to be used not only to produce the new (after jump) address, but also to compare the current read address R with the current write address W, to determine when it is necessary to make a jump. Adder 26 continuously monitors each write address as it increments to compare that new write address to the current value of the read address. To do that a signal from jump flip flop 29 is ordinarily in a relaxed condition (the $W/\Delta P$ MUX is normally set up to the W position) so that ALERT DETECTOR 27 can continually compare W against read R. For the case of expansion and the case of compression different algorithms are used to determine when it is necessary to jump. However, a single condition will allow determination of when it is necessary to jump but also of whether the mode is expansion or compression.

Alert detector 27 monitors the output of adder 26 to determine when this alert condition has happened and when a jump must occur in order to avoid a discontinuity of the signal which would occur if write pointer coincided with the read pointer. When an alert happens, load control 30 is signaled and it combines the read write timing signals R/W TIMING so that it asserts the load signal once, and once only, just ahead of the R count signal, so that only one jump is made at each time a jump requirement is detected.

A plus minus flip flop 28 monitors the condition of the alert detector and thereby determines whether operation is in expansion or compression. For expansion it is necessary to assert the signal carry CY (which also feels the exclusive OR which is part of the 9-bit signed adder 26) to cause the 9-bit signed adder 26 now to assume the sign of a negative. In other words, it subtracts to produce $R-n\Delta P$. That same flip flop 28 is commanded by ALERT DETECTOR 27 when it is necessary to be in the minus condition for a comparison between the read and the write addresses in order to assert jump flip flop 29.

The amount of the jump, $n\Delta P$, is determined by the pitch period processor. This circuit is a combination of analog circuits and digital circuits. The input audio signal is applied to a glottal pulse detector 32. Detector 32 is a device that is predominantly a filter that tracks the incoming audio at varying speed according the value of C provided. If, as in a tape recorder application, there are variations in the playback speed, detector 32 tracks these, so that the parameters are normalized against the original recorded frequencies. It monitors the audio peaks to detect those peaks and advises the START/STOP transfer logic 36 that is has found each new peak.

A 9-bit ripple counter block 33 is continuously counting at the write clock, WCNT. It transfers its latest count into 9-bit latch 34 and starts counting again on receipt of each signal from START/STOP 36. The START/STOP transfer logic 36 receives another input called UPDATE INHIBIT out of the jump flip flop 29 that is necessary to keep the $n\Delta P$ number from changing simultaneously at the very time it is used to make the jump. In that event the transfer of the 9-bit ripple counter which is asynchronous with the W count would be held long enough so that it will not disturb the 9-bit latch 34 during the time of the read cycle when data must be available. After that, the update occurs. A limits detector 35 monitors the current value of the 9-bit ripple counter 33 as it counts up until it reaches a certain minimum number. Until that minimumm is reached, even though another start/stop signal occurs it will be ignored. Once that minimum has been exceeded, however, a new glottal pulse peak detection from detector 32 initiates start/stop transfer. If a certain maximum count in ripple counter 33 is reached without a glottal pulse peak being detected by detector 32, limits detector 35 will reject that maximum as being a number that is too large, in which case there is no update. In that case the last value that was resident in the 9-bit latch 34 is used. The 9-bit latch 34 always has a number available for the $n\Delta P$ value should it be needed. This flexibility is necessary because the jumps taken by JUMP CONTROL occur only when required by the relationship of the read and write pointers and this requirement bears no relation to the occurence of glottal pulses detected out of detector 32 (or to any signal criterion.

Typical values for the limits of the limits detector 35 in the range of 10 milliseconds and 20 milliseconds, normalized to the output signal, were found to produce good results. This interval for a valid glottal pulse period corresponds to a pitch (i.e. fundamental frequency) range of 50 Hz and 100 Hz. If the incoming audio is at a higher frequency, the detected $n\Delta P$ will be close to the minimum limit (i.e. 10 ms) because of the high frequency of the detected peaks coming out of detector 32. That is, as soon as the limits detector 35 reaches that minimum number it is likely that a peak will come along and START/STOP 36 will load that number close to 10 ms into the 9-bit latch 34 and then start another cycle. Similarly if an unvoiced sound occurs, (e.g. white noise), a minimum number will be accumulated in 9-bit latch 34. A minimum value significantly less than 10 ms would result in a needlessly high processing rate, while increasing the maximum value is limited by the size of the memory. In this embodiment, the maximum was chosen to be half the memory size, which makes it convenient to determine the sign of the number out of the 9-bit signed adder 26.

Figure 4B:
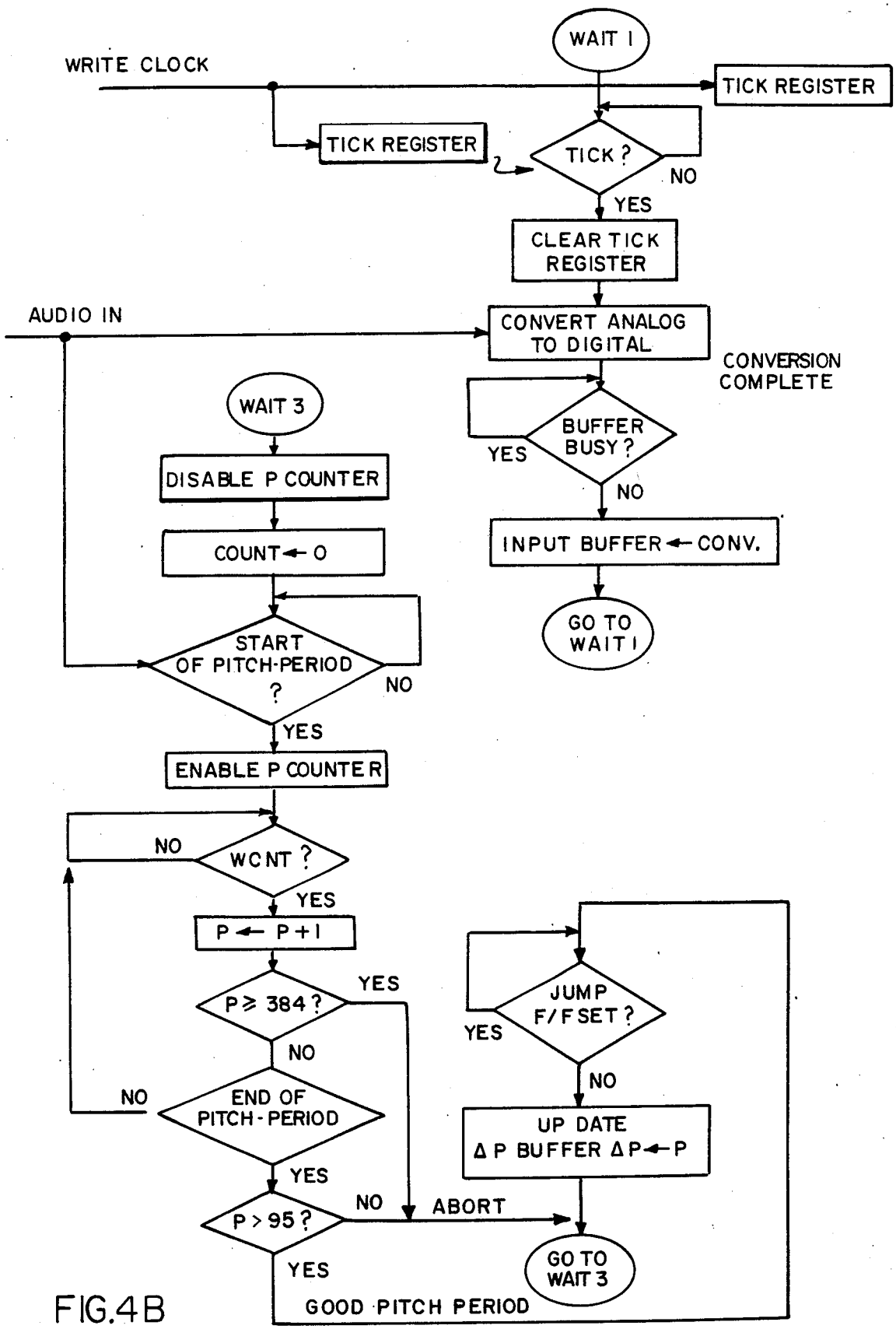
FIG. 4B is a flow chart showing analog to digital conversion of the input audio signal and the derivation of the glottal pulse pitch period signal from the audio input signal.

The system operates by program control as shown in FIG. 4A and 4B to make the jump as the write pointer approaches the read pointer. The flow chart is written as having two processors working on the blocks of WAIT 1 and WAIT 2. WAIT 1 stands for processor 1 and WAIT 2 for processor 2. The system has separate hardware elements that are working in concert at the same time, so there is not a single processor. Their operation is described as distinct by using the processor notation WAIT 1 and WAIT 2 to show that there are processes that are going on simultaneously.

The ACCESS CONTROL PROCESSOR of FIG. 3C is programmed as flow charted under WAIT 2. There are two competing processes, a write clock process (FIG. 4B) and a read clock process (FIG. 4A) that are waiting for processor number 2. Processor number 2 is devoted to doing the business of the random access memory which cannot read and write simultaneously. The decision block called ANY TICK? is a waiting loop used while the ACCESS CONTROL PROCESSOR is waiting for something to happen. ACCESS CONTROL has two tick registers 21, 22. When either tick register is set the tick decision block exits on the YES side into FLIP FLOP TO ONE ONLY, READ ELSE WRITE (corresponding to flip flop 23). Taking first the write cycle, the program signals the analog digital converter 12 to stay out of the input buffer FIG. 4B (BUFFER BUSY?) Then after a delay, it permits that buffer to clear had it been busy. This operation is CLEAR THE WRITE PROCESS TICK REGISTER. It can be done any time in this flow, but it is convenient to do it here. Next the input buffer is transferred to the random access memory. (In FIG. 3A the input buffer 14 is strobed by the input strobe and data is written in through the bidirectional I/O line into RAM 17.) Then the analog to digital converter, if it happens to be converting at that particular time, is cleared. The next step is to check POINTER ALERT. Here the output of the jump control 9-bit signed adder 26 is used to compare the read address against the write address to find out if the separation of the two pointers is collapsing. Most of the time the program will find that the pointers are not collapsing so the NO exit is taken. Then the only remaining order of business in the write process is to advance the write pointer, that is to increment the 9-bit ripple counter 20. Then the program goes to WAIT 2. Now because the write process tick register was cleared, when the program comes back up to WAIT 2 it will hit the interrogation block ANY TICK?

and there will not be a tick coming from the write clock. But a tick might have been recognized from the read clock. In that case ANY TICK YES goes to ONLY READ ELSE WRITE and selects READ because WRITE has been satisfied.

In the read process it is necessary to switch the POINTER MUX to select the 9-bit read address from counter 19. That is only done in the read process since the write process assumes that a write address is always available. Next the program advances the read pointer, changing the R count signal, RCNT, which tells counter 19 to increment to R+1. Note that there is an increment even if there is a jump. Next is an unconditional delay to insure that the count has settled on the output lines of counter 19.

This is a convenient place to clear the read process tick register that started this read cycle. With the addresses settled it is now time to read the RAM to OUTPUT BUFFER. It is not read at this time directly to the audio output because to do that that would cause the output to jitter. To assure that the output will be very regular, the RAM is written to the output buffer.

The output buffer 15, although it is connected to the digital to analog converter DAC 16, has a built in latch so that although the DAC is connected the last piece of data is holding on the output. Under the control of the read clock the program strobes that output buffer to the DAC latch. This is shown in the upper right hand portion of the flow chart. The strobe occurs always on the leading edge of the read clock. The last value that was resident in the buffer, when last read, is then transfered to the latch half of the digital analog converter 16. Because that read clock also triggers the tick register there will not be a read cycle that's occupying that buffer at the same time.

After reading the RAM to the output buffer, the program moves to an interrogation block where it is asked "is JUMP FLIP FLOP SET?" The jump flip flop is part of the write process. If it has not been set, a NO output returns the READ pointer mux to the write selection and again the program goes back to WAIT 2.

After satisfying the read process the program will not do another read until the clock RCNT has gone low and then again high. If after the read process the write clock had left something in the tick register the program again would immediately follow through and do the write cycle. For the conditions which follow on the write cycle the pointer alert that is doing a comparison using the 9-bit signed adder 26 with the W P MUX in the W position which it ordinarily is in, compares the read address with this latest write address. If the POINTER ALERT has signalled yes, (there is an impending collision of the two pointers,) then alert detector 27 will have a signal asserted, and it will be used to set the jump flip flop 28. At the same time that jump flip flop is set the W/ΔP MUX is toggled over to the ΔP position because the next order of business will be for the read process to employ nΔP, to accomplish the jump. To set a pointer alert here required a comparison, that is the +/− flip flop 28 is ordinarily set in its minus condition, because subtraction is equivalent to a comparison. When the jump flip flop is set to do a jump, and the 9-bit signed adder is also set in a positive condition, as an adder, it is for the case of compression, for a jump forward. In that event the flip flop is set to plus. Otherwise it is left in the minus position for the case of expansion. The way to determine the polarity is to examine the output of the 9-bit signed adder to determine the sign of R−W. All of the bits out of the 9-bit signed adder are examined to determine whether they are positive or negative. If they are small and positive then it must be because the pointers are collapsing in that particular direction—i.e. the case of compression. If they are small and negative, it must be because the pointers are collapsing in a direction that means to expansion. Even though the sign is determined, there is no jump because the program is in the write process. The program sets the jump flip flop and goes over to the read process toward the condition block to interrogate in the read process whether the JUMP flip flop is set. In the next read process the program interrogates the jump flip flop and since it is set, it takes the branch. This will jump the read pointer which takes R to R+ or −nΔP, the plus or minus being determined by the plus or minus flip flop block 28, which had been set in compression during the write process. Making the jump clears the jump flip flop to acknowledge the fact that the write process had called for a jump which was executed. Thus the program jumps only once, until the condition happens again.

Now the W/Δ MUX 31 is returned to its normal condition in the write position, and the plus minus flip flop 28 is cleared to its normal condition, being minus. To repeat, in the write process the two conditions of being in the minus position and being in the W position are always needed to compare W against R to determine if a jump is required. The last order of business in FIG. 4A is the steer the pointer MUX to its normal position, i.e. WRITE.

The program for analog to digital converter 12 is shown under WAIT 1 in FIG. 4B. The tick register 21 monitors the write clock. If the write clock leading edge happens at this time, this processor can recognize it in the same manner that WAIT 2 did. The first thing it does is clear this tick register and that causes the conversion from analog to digital. To determine where to store that data it must examine whether or not input buffer 14 is busy, because the process of WAIT 2 could be accessing it at the same time. If buffer 14 is free to be used then BUFFER BUSY? is NO. This takes the conversion from the analog to digital converter 12 and puts it into the input buffer 14. The program immediately goes back and starts another conversion unless WAIT 2 process signals it to stay out of buffer.

That same audio analog signal that is about to be converted to digital is being used by the analog pitch period detector 32 to decide whether or not there is a start of a pitch period, by detecting a glottal pulse. Under WAIT 3, another processor (which is nothing more than a counter and a few gates) is counting the interval between glottal pulses of the audio input. First the program disables the peak counter 33, to stop the input pulses and set the count to zero, and then it waits for a new glottal pulse to appear. The counter 33 is reset to a starting condition of zero. The last value of the pitch period that was counted is not lost because it can be resident in 9-bit latch 34. When a glottal pulse comes in from the analog pulse detector 32 the program exits the START OF PITCH PERIOD in the yes branch and enables the peak counter 33. Enabling the peak counter 33 allows the W counts WCNT to come in on the right hand side of the 9-bit ripple counter 33. The system monitors the glottal pulses and each count advances the counter, P becomes P+1. The limit detector 35 checks whether or not the high limit count is overrun, that is, if the count is greater than 384 which is about ¾ the size of the memory and equivalent to roughly 20 ms. If YES, the count is greater than the high limit and it means there was a long interval between glottal pulses (longer than is expected in normal speech), so it must have been a pause in the speech. JUMP should not be based on such a signal because that is not a steady state condition, so in that case the program just aborts and goes back to WAIT 3. Note that when program follows that branch it does not change the number that is still resident in 9-bit latch 34.

If the number is less than that maximum, then the program asks whether or not the end of pitch period has happened. If there is a glottal pulse, the count is stopped and the program exits via the yes branch and then examines the number in the P counter to see if it is greater than 95. This is an arbitrary limit that is set, equivalent to the 10 ms minimum limit. If the number is greater than that very small minimum then it is called a good pitch period because it had to be less than or equal to 384 and it had to be greater than 95 which constitutes good pitch period (i.e. a voiced pitch). Tne the program asks if the jump flip flop is set. If the jump flip flop is set latch 34 is not changed because the read cycle may be using it at the same time. If the jump flip flop is not set then the read cycle is not about to use the n$\Delta$P that is resident in the 9-bit latch 34 so $\Delta$P BUFFER is updated. In that case the number from the 9-bit ripple counter 33 is transfered to the 9-bit holding latch 34 and that ends that cycle.

When a cycle is ended a new one starts. The program disables the peak counter and sets the count to zero, to START OF PITCH PERIOD. In this case the answer is yes because the start of one signals the end of another, or vice versa—the end of one will signal the start of an other. If YES, the program resides for most of the time in a loop following the "enable P counter" and W count WCNT, loops on the "no" branch. This is the waiting time which increments the P counter upon each write cycle and keeps incrementing that counter until another end of pitch period is found or the count exceeds the upper limit. As long as the count is less than 384 the loop repeats until the end of pitch period and as long as "end of pitch-period" is NO, meaning that the next glottal pulse has not occurred, the program continues to loop and increment the P counter on each new write count. Thus the program counts the number of write cycles between glottal pulses, and this interval when found is loaded into the 9-bit latch 34.

Figure 5:
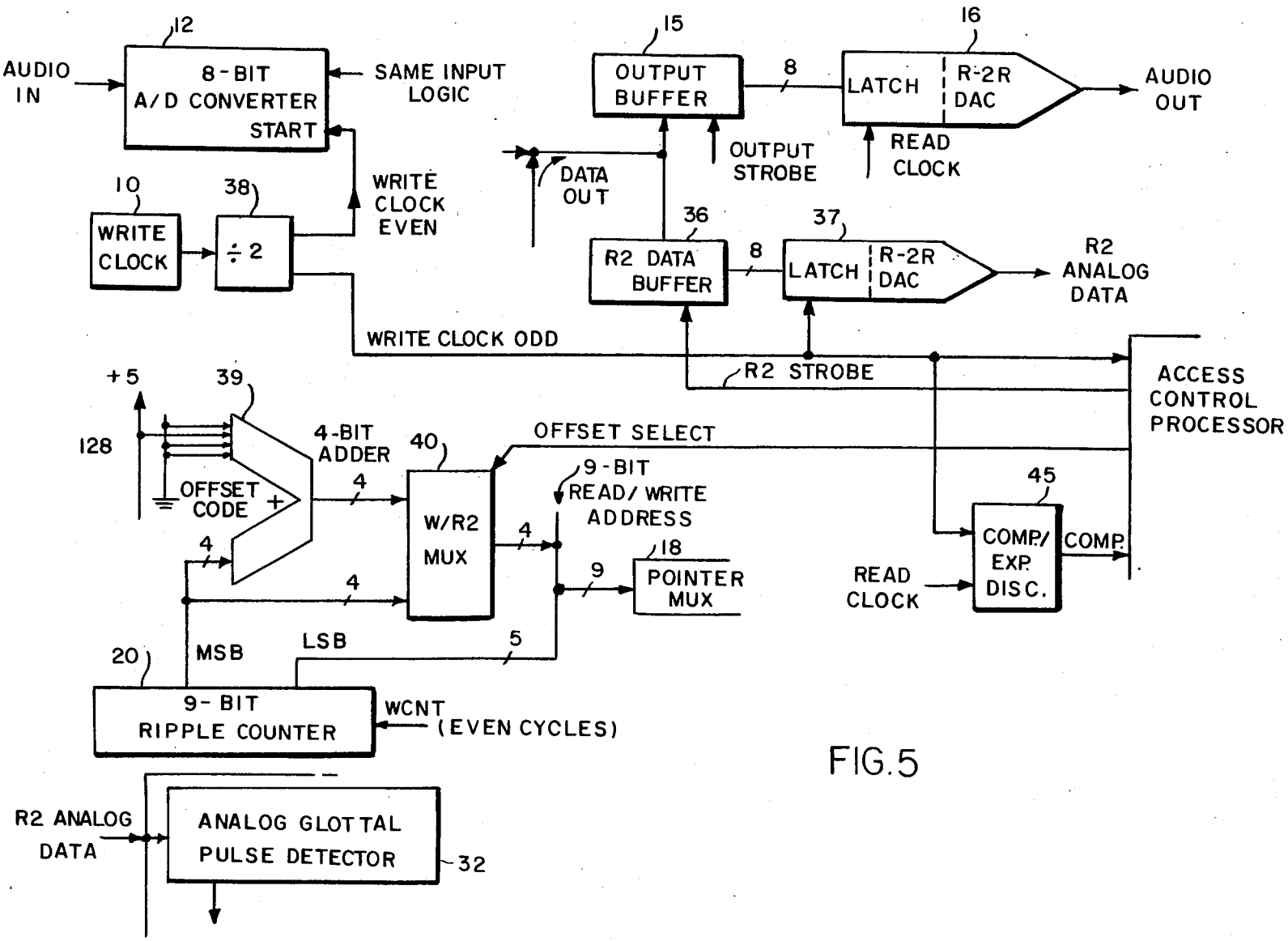
FIG. 5 is a partial block diagram corresponding to FIG. 3 showing the modifications for operating with two read pointers.

Referring now to FIG. 5, a modification for control of the two read pointer systems introduced in FIG. 2 will be described. FIG. 5 shows only enough of FIG. 3 to illustrate the changes made for this improvement.

This embodiment addresses the problem of the large time delay between the detection of glottal pulses and the use of this information for the Read Pointer jumps. It improves operation by providing an auxiliary Read Pointer in fixed relative position to the write pointer and used solely for the purpose of providing data to the glottal Pulse Detector 32.

This data from read pointer R2 is read out of memory through an additional DAC 37, buffered by an additional output buffer 36. It should be noted that depending upon the speed capabilities of a typical DAC, a single DAC may serve in a multiplexed capacity to provide the secondary "R2 Analog Data".

Whether or not an additional DAC, or a single multiplexed DAC is employed, an additional strobe timing signal is required from the Access Control Processor. This signal called R2 Strobe is generated by Access Control Processor in response to a request for Access to the RAM derived from WRITE CLOCK ODD.

WRITE CLOCK 10 is necessarily doubled in frequency for this refinement. A divide-by-two flip/flop 38 delivers two alternating signals. One of them, WRITE CLOCK EVEN, is used to signal the input A/D converter 12 in the same manner and at the same frequency as was used for the system of FIG. 3. Access to the RAM for writing the digital data into memory is synchronized from this signal in a manner similar to the basic system.

The new signal WRITE CLOCK ODD, gains access to the RAM by way of the Access Control Processor to cause a READ Process to occur in between each WRITE process, and so this new READ process occurs at the same controlled rate as the WRITE processing. The WRITE aspect of WRITE Processing is the same as in the basic system, however a new READ aspect is added so that the Audio Input signal can effectively be shifted along the time-axis before being applied to the Glottal Pulse Detector 32.

In the case of an Analog Glottal Pulse Detector, an additional DAC function is needed for this refinement. Such additional function may be provided explicitly in the additional DAC 37 or it may be derived implicitly by suitable multiplexing of DAC 16 of FIG. 3 with subsequent analog demultiplexing.

For the case of a Digital Glottal Pulse Detector, only the additional READ aspect of WRITE Processing is required.

For which ever type of data processed, the remainder of this description affords the addressing to effect the aforementioned time-axis shift of the audio input signal.

The 9-bit RIPPLE COUNTER 20 is the same Write Pointer Counter as in the basic system. A new offset structure comprised of a 4-bit Adder 39 and W/R2 Selection Multiplexer 40 provides for the time-axis shift.

An example of an "offset code" of 128 is shown as an input to the 4-bit Adder 39. This number may be any number that can be represented with the upper 4-bits of a 9-bit code, 128 happens to represent one-quarter of the 512 possible WRITE addresses. The smallest possible number for a 4-bit offset code is 32, representing 6¼% of the depth of the data memory. Other codes in increments of 6¼% are possible.

The secondary R2 Analog Data may be selected to be read out of memory either ahead of the WRITE Pointer or behind the WRITE Pointer depending upon the phase relationship of timing signals OFFSET SELECT and WRITE CLOCK EVEN. If OFFSET SELECT is asserted to select the 4-bits, from 4-bit Adder 39 at the same time as WRITE EVEN causes data to be written into memory, while READ Aspect R2 Strobe occurs when OFFSET SELECT is unasserted to select the 4-bits directly from counter 20, then the R2 Analog Data will lag behind the Audio INput by the amount of OFFSET CODE. Conversely, if the phase relationship of OFFSET SELECT is such that it coincides with WRITE CLOCK ODD, then it will be the Audio INput that lags behind. But because the memory is a circular store, the offset is to have R2 Analog Data lagging behind Audio INput by the full size of the memory (for example 512) less the amount of OFFSET CODE.

A further feature of this refinement is COMPRESSION/EXPANSION DISCRIMINATOR 45. This logic block compares the writing rate against the reading rate and so is able to assert a logic signal "COMP" when the writing rate exceeds the reading rate. ACCESS CONTROL PROCESSOR is thus able to make use of this information in deciding which phase relationship to apply to OFFSET SELECT.

It will be seen that if OFFSET SELECT is left at a steady logic level, either logic true or logic not true, then addresses derived from counter 20 are effectively the same for WRITE CLOCK EVEN and WRITE CLOCK ODD, providing a condition of zero offset regardless of the value of "OFFSET CODE". It is this condition of zero offset that is desirable for the case of Expansion, wherein the READ Pointer jumps backward away from the WRITE Pointer, jumping over data that has just been evaluated for its pitch-period.

For the case of compression, the READ Pointer tends to lag behind the WRITE Pointer and this lag becomes progressively greater until it becomes necessary to jump ahead because the full size of the circular store is filled and the WRITE Pointer will soon overun the READ Pointer resulting in an uncontrolled "jump" and a consequential indeterminate splice of the output data. Accordingly, when a jump is taken just slightly before this overrun condition and it is taken only by the amount of "nΔP", the resulting READ Pointer will still likely be deep into data memory. In fact, with this "Jump-On-Necessity" Logic, the READ Pointer manages to just stay ahead of the WRITE Pointer in the circular store. This behavior is perfectly acceptable when the speech waveform is reasonably steady-state in Pitch-Period. But when the Pitch-Period is "gliding" to a new value, and when it is being derived from the Audio INput, then the Pitch-Period most recently evaluated may be considerably in the future in respect to the READ Pointer. It is for this condition that this R2(W) modification of FIG. 5 proves most useful. By providing an offset such that R2 Analog Data comes from data deep into the circular store, then the evaluation of Pitch-Period can come from data that is more nearly aligned in time with the section of memory over which the primary READ pointer will actual make its jump.

Accordingly, the preferred embodiment of this refinement is to operate with OFFSET SELECT at a steady level for zero offset when COMPRESSION-/EXPANSION DISCRIMINATOR (45) indicates the case Expansion (COMP.=0) and for the case of Compression (COMP.=1) to operate the OFFSET SELECT asserted in an in-phase relationship with WRITE CLOCK ODD so that R2 ANALOG DATA is extracted ahead of the WRITE POINTER by the amount of "OFFSET CODE".

Figure 6:
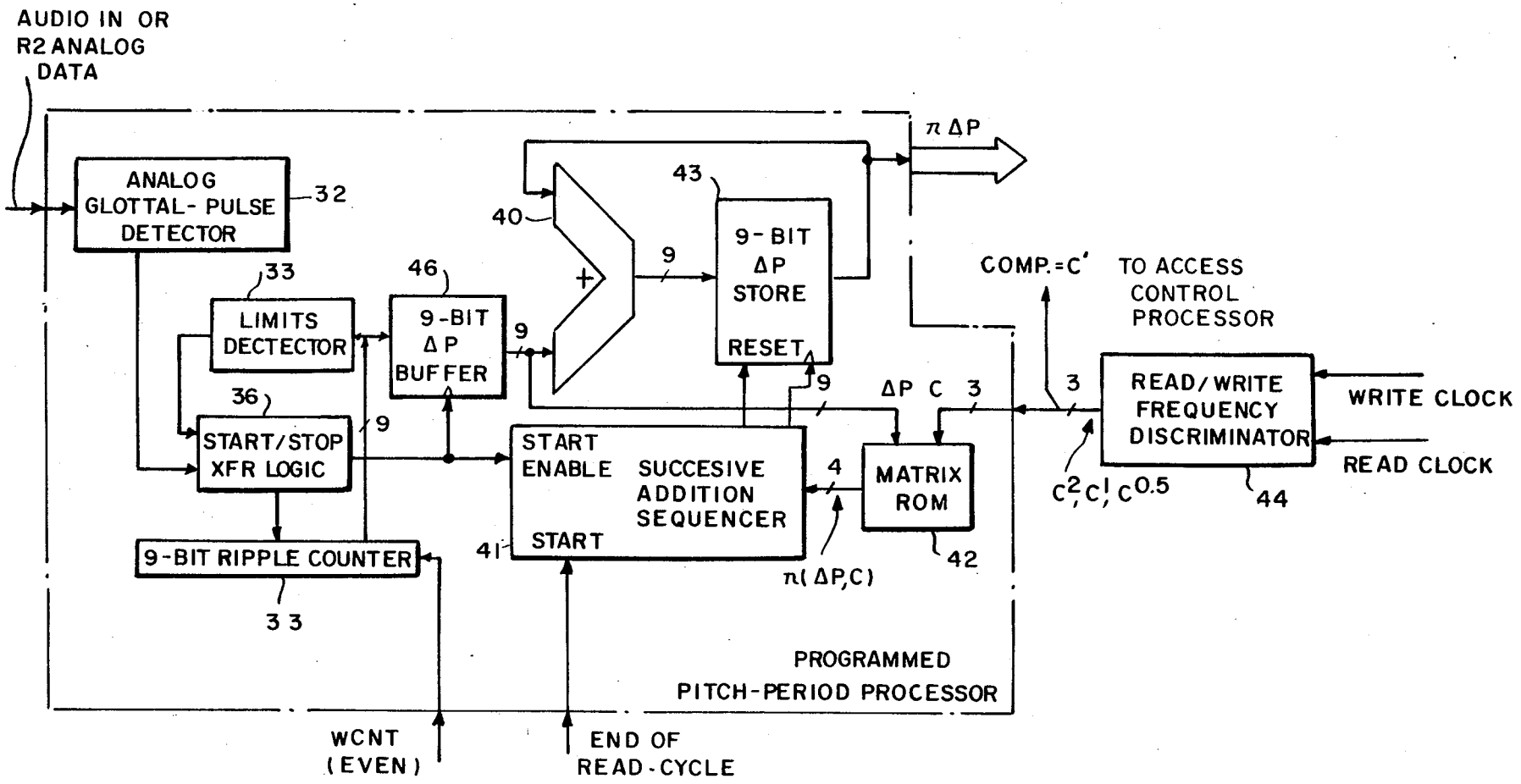
FIG. 6 is a partial block diagram corresponding to FIG. 3 showing modifications for operating with an adaptive pitch period.

Another embodiment of the invention affords two distinct features either for the Basic System of FIG. 3 or for a Basic System refined according to R2 (W) as in FIG. 5. The modifications of FIG. 3 used to implement these features are shown in FIG. 6.

The first feature affords a means to obtain a multiplicative value for nΔP, wherein ΔP comes from a measurement between exactly two glottal pulses and "n" is either fixed or is derived from the second feature. This first feature thus affords a means to obtain a jump value that can be derived from the smallest possible time interval (n=1) and is therefore more often available than a value that is derived by counting over more than one Pitch-Period (n=2, 3, etc.) and can thereby be more recently representative when Pitch-Period is rapidly changing.

The second feature affords a means to control the "keep interval," the interval between jumps which becomes more important at higher values of compression "C" when the WRITE POINTER speeds away from the READ POINTER so fast that jumps are necessary so often that the READ POINTER is never able to deliver a contiguous segment that is long enough to guarantee that it contains at least one glottal pulse. Such higher compression ratios dictate the use of larger discard segments to insure that the keep segments will be of adequate length; however, at lower compression ratios, shorter discard segments may be preferable. Accordingly, Matrix ROM (Read-Only-Memory) 42 provides a means to adapt a large memory for purposeful full exploitation for large C and for purposeful partial exploitation for C more nearly unity. The absolute value of jump equivalent to the discard segment can be the design objective, because "ΔP" is part of the Matrix input.

READ/WRITE FREQUENCY DISCRIMINATOR 44 compares the writing rate against the Reading rate and provides a 3-bit binary measure of compression "C". Thus $C^2$ output represents compression, $C^{0.5}$ represents expansion and $C^1$ is normal playback with no pitch change. A "P" counter provides a frequently updated 9-bit binary number representing the interval of address locations between glottal pulses. Together these 12-bits provide a look-up address for Matrix ROM 42. The Matrix ROM 42 provides as the operand of its look-up a 4-bit tabled data element representing the desirable value of "n" from n=1 to n=15.

A 4×4K=16K-bit ROM is sufficient although certainly not necessary for the size of Matrix ROM 42. Combinational Logic on the 12-bit addresses ΔP and C can be used to reduce this memory requirement.

The ΔP is counter 46 is comprised of the 9-bit RIPPLE counter 33, START/STOP TRANSFER LOGIC 36 and LIMITS DETECTOR 33 forming an interval counter for the number of write pulses between exactly two pulses from Analog Glottal Pulse Detector 32. This is simply a specialization of the nΔP counter of the system of FIG. 3, but with LIMITS DETECTOR 33 set sufficiently low that n=1.

ΔP Counter stores its most recent measurement in 9-bit ΔP BUFFER 46, and each time it does so it signals successive ADDITION SEQUENCER 41 that new data is available.

After each data sample is read out of RAM 17 (FIG. 3), the successive ADDITION SEQUENCER receives a synchronizing start signal END OF READ CYCLE. If new data is available from the ΔP counter, the SUCCESSIVE ADDITION SEQUENCER will begin to perform "n" successive additions and will complete its operations before the next READ-CYCLE when "nΔP may be required. A RESET signal is first sent to a 9-bit nΔP store 43 to clear it to zero. This zero appears on a 9-bit adder 40 together with the new ΔP from the ΔP counter. A strobe signal is then issued to nΔP STORE 43 from the sequencer 41 so that it takes the sum of ΔP and zero. If n(ΔP, C)=1, the sequence is completed. For n(P,C)≧2, successive strobes are issued, with only a short settling time required between strobes. Thus the nΔP STORE accumulates ΔP+0=ΔP, ΔP+ΔP=2ΔP, 2ΔP+ΔP=3ΔP and so on until "n" is satisfied, where the value of "n" is obtained from MATRIX ROM 42. For example, higher C values would require a larger n, while larger ΔP values would require a smaller n.

An alternative mode of operation of FIG. 3 will now be described. Its objective is the same as that to be described with reference to FIG. 5 in that it seeks to minimize the delay between the Pitch-Period information and the READ POINTER for the case of compression ($C<1$). In so doing it also makes the size of the circular store less of a design consideration.

The architecture for this refinement is the same architecture as that of FIGS. 3 and 4, the only modifications necessary are contained in the timing signals that are generated by the ACCESS CONTROL PROCESSOR.

The modification may be thought of as producing a "trial jump" between each and every READ ACCESS, so that a second virtual ALERT POINTER is created, running at the READ rate but running ahead of the READ POINTER by an amount $n\Delta P$. Then the ALERT DETECTOR 27 instead of operating on the quantity "R-W", operates on the quantity "$R+n\Delta P-W$". The criteria for ALERT (when a jump is to be taken) then becomes not a JUMP-OF-NECESSITY but rather a JUMP-ON-OPPORTUNITY.

The modification need only apply to the case of compression. The case of Expansion remains unchanged, its ALERT Logic is still the Jump-of-Necessity but because its READ rate tends to overtake the WRITE POINTER, the two pointers tend to maintain a close separation with the READ POINTER only in shallow memory. Thus the Pitch-Period information obtained from the Audio INput (essentially equivalent to the information being written into the memory by the WRITE POINTER) can be used for determining the jump distance without introducing an error due to spatial separation in the memory.

The Pitch-Period being extracted from the AUDIO INput is that corresponding to the signal information stored in shallow memory. This is generally a desirable feature because it means that when the Pitch-Period changes the speech waveform that belongs to that change is in recent memory. If a jump is taken over that same waveform it will produce a good splice, since the Pitch-Period information used is that of the signal actually jumped over. But the the READ POINTER is allowed to sink deep into memory the waveforms that it jumps over have been measured for Pitch-Period at a much earlier time and if the Pitch-Period is changing and is being continuously updated, the appropriate $n\Delta P$ for the jump is no longer available.

"JUMP-ON-OPPORTUNITY" for the case of compression, "Jump-On-Necessity" for the case of Expansion is the strategy that this refinement employs to operate always in shallow memory.

Implementing this refinement is easiest when the ALERT Logic is not required to make the COMPRESSION/EXPANSION decision as it did in the Basic System. A READ/WRITE FREQUENCY DISCRIMINATOR can perform this function as hereinafter described with reference to FIG. 7, so that for the case of Expansion this refinement reverts to the basic system of FIG. 3. For the case of compression, an additional function of the READ counting is required, the "TRIAL JUMP".

The READ Access of FIG. 3 is left unmodified, however the WRITE Access is expanded to perform the Trial Jump and the ALERT testing. At the beginning of WRITE Access, not only is data written into memory but a Trial Jump is commanded of the READ address counter. The W/ΔP Multiplexer 31 is reset to "W" and "+/−" to "−" so that a comparison can be made between the trial jump and the current WRITE Address counter, which is the ALERT test. The result of the test then determines whether or not the trial jump will be retained as an actual jump.

In the remaining expanded portion of the WRITE Access, the READ Address Counter is either commanded to return to its original value or simply left in the "$R+n\Delta P$" condition, thus constituting a jump. Most often the ALERT test indicates that the Trial Jump should be reneged, so a second command is issued after having returned the W/ΔP Multiplexer 31 to ΔP. The result of this second, conditional command, is $R=R+n\Delta P-n\Delta P$, the original READ POINTER value.

The last item of business in the expanded WRITE Access, is to update the $n\Delta P$ Counter 33. It is important to note that the $n\Delta P$ that is used for the Trial Jump is not changed before it will again be used to renege the jump.

The criteria for the ALERT Test to decide to retain the Trial Jump is simply that there is "room" to Jump. If the Trial Jump causes the ALERT POINTER ($R+n\Delta P$) to exceed the WRITE POINTER then it is not yet time to retain the jump, and the Trial Jump is reneged. This strategy ensures that the READ POINTER sinks no deeper into memory than it has to. As soon as it has sunk back far enough that it can jump forward by n P without overtaking the WRITE POINTER, it does so. The result is that the READ POINTER operates in the same shallow memory for both the case of Expansion and now also for the case of compression.

Figure 7:
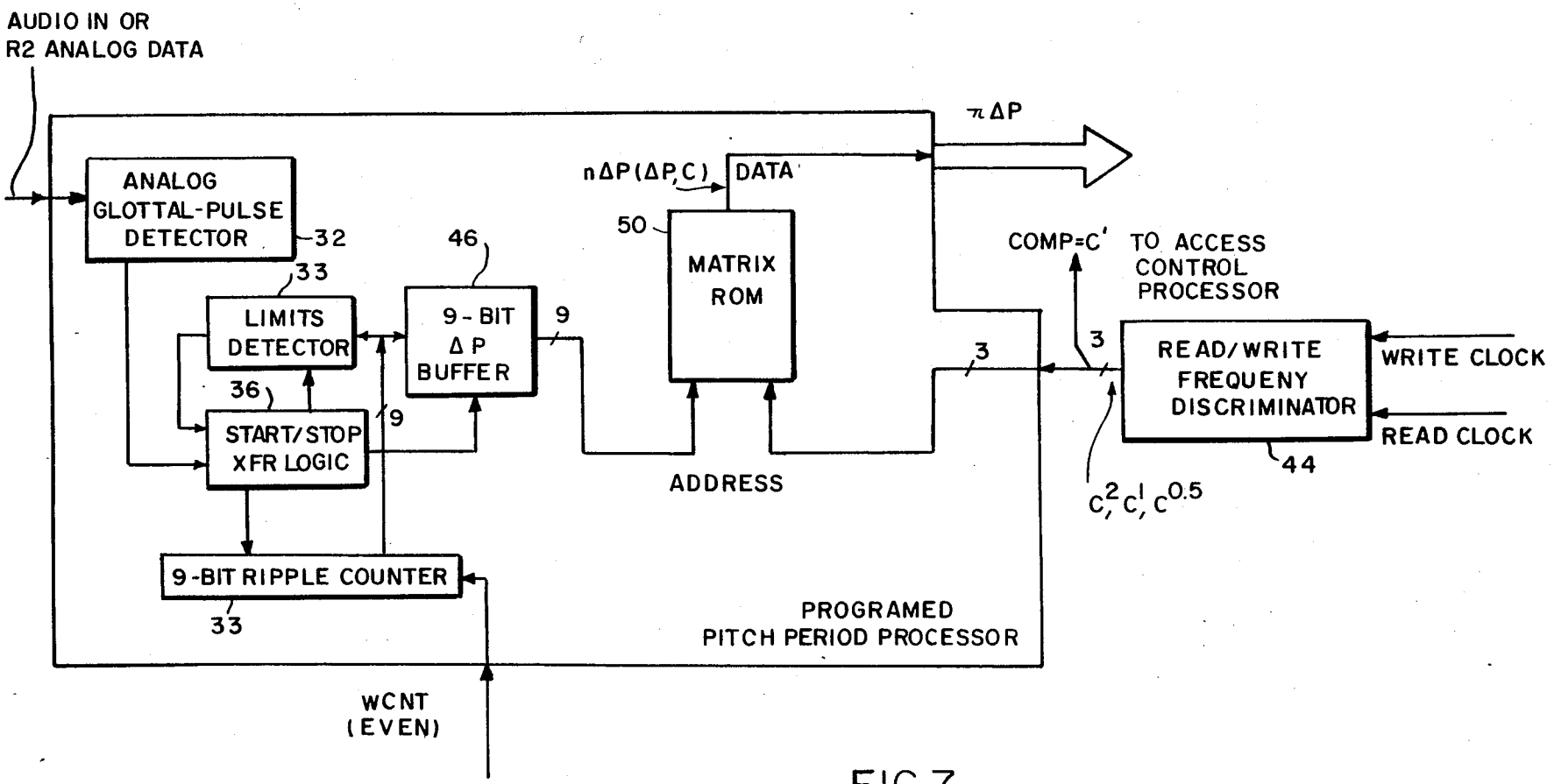
FIG. 7 is a partial block diagram corresponding to FIG. 3 showing a modification for greater memory utilization in the pitch period processor.

An alternate to the embodiment of FIG. 6 is shown in FIG. 7. The system of FIG. 7 provides all of the features of FIG. 6 and adds the additional ability to provide predetermined default constants for $n\Delta P$ under certain specified conditions.

This new version trades-off the complexity of the successive addition sequencer 41 and the 9-bit signed adder 40 for a larger READ-ONLY-MEMORY (ROM) 50. Instead of computing the value of $n\Delta P$, all values are tabled in MATRIX ROM (50).

For those conditions for which ΔP is within a reasonable range, the values tabled in the MATRIX ROM (50) are simply ΔP multiplied by the most advantageous integer n for the C rate. Thus the multiplication is already taken care of when the Matrix ROM 50 is consulted in real time.

For those conditions for which ΔP is unreasonably small or large, the values tabled can be "default" values that have been determined to be most appropriate for the particular C rate.

Various modifications of the disclosed embodiments will now be apparent to those skilled in the art. The invention is to be considered as including all such variations as come within the scope of the appended claims.

We claim:

1. The method of altering the pitch of an audio signal comprising the steps of:

sampling said audio signal at a first rate and writing consecutive signal samples so derived in a random access memory;

reading said memory at a second rate to recover stored samples as output signals in the same consecutive order, said first and second rates having a ratio according to the pitch alteration desired;

determining the pitch period of said audio signal; and resetting the start location of continued reading of said stored samples from said memory to a location separated from the last reading location by approximately the number of consecutive samples within an integral number of said pitch periods whenever the writing and reading locations in said memory are separated by less than a predetermined ddifferential said resetting being in a direction such that moving said start location of continued reading never crosses said writing location.

2. Apparatus for pitch conversion of audio signals comprising:

means for deriving sequential samples of said audio signals;

an addressable memory:

means for writing said samples at a first rate into said memory for storage and retrieval;

means for reading said samples from said memory at a second rate in ordered sequence corresponding to said sequential samples;

means for determining the pitch period of said audio signals;

means for resetting the start location for continuing said reading of the stored samples from said memory to a location separated from the last reading location by approximately the number of consecutive samples within an integral number of said pitch periods whenever the writing and reading locations in said memory are separated by less than a predetermined differential, said resetting being in a direction such that moving said start location for continuing said reading never crosses said writing location; and means for utilizing the sequence of signals read out of said memory to produce an output signal.

3. Apparatus according to claim 2 wherein said second rate is greater than said first rate whereby the reading location approaches the writing location in said memory and said resetting shifts said start location for said continued reading backward in said sequence thereby repeating some of said samples in said output signal.

4. Apparatus according to claim 2 wherein said second rate is less than said first rate whereby the writing location approaches the reading location in said memory and said resetting shifts said start location for said continued reading forward in said sequence thereby discarding some of said samples from appearing in said output signal.

5. Apparatus for pitch conversion of audio signals comprising:

a random access memory having address locations for storing data samples representing said audio signals;

means for sampling said audio signals to obtain sequential samples and writing said samples at a first rate to write address locations in said memory;

means for reading said samples for said address locations in said memory at a second rate to obtain an output signal of said sequential samples;

means for determining the pitch period of said audio signals;

means for resetting the start address for continued reading of said samples to an address separated from the last read address by approximately the number of consecutive samples within an integral number of said pitch periods whenever the separation between writing and reading address locations becomes less than a predetermined minimum or greater than a predetermined maximum, said resetting incrementing said separation tgo be respectively greater than said minimum or less than said maximum by moving said start address for continued reading so as never to cross said writing address.

6. Apparatus according to claim 5 wherein said audio signals are applied as the input to said means for determining pitch period.

7. Apparatus according to claim 5 including second means for reading said samples at said first rate at an address location near the current writing address location, the output of said second means being the input to said means for determining the pitch period.

8. Apparatus according to claim 7 wherein said second rate is less than said first rate and said spacing is selected to have said second means read from said memory closely ahead of said writing.

9. Apparatus according to claim 7 wherein said second rate is greater than said first rate and said spacing is selected to have said second means read from said memory contiguous with or closely following said writing.

10. Apparatus according to claim 7 wherein said second reading means reads from memory closely ahead of said writing and including switch means responsive to determining that said first rate is less than said second rate for disconnecting the output of the said second reading means from the input of the means for detêrmining the pitch period and simultaneously connecting said audio signals to the input of said means for determining the pitch period.

11. Apparatus according to claim 5, 6, 7, 8 or 9 and including means for determining if said pitch period is outside predetermined upper and lower values for pitch periods, and means for modifying said resetting whenever said pitch period is outside said limits.

12. Apparatus according to claim 11 wherein said means for modifying said resetting includes means responsive to determining that said pitch period is greater than said upper value for discarding from said output a sequence of samples corresponding to a predetermined value; and means responsive to determining that said pitch period is less than said lower value for discarding from said output signal a sequence of samples corresponding to a second predetermined value.

13. Apparatus according to claim 12 wherein said second predetermined value is selected to be a multiple of said predetermined minimum pitch period value.

14. Apparatus according to claim 11 and including means for storing the current value of said pitch period only if such value is within said limits and means responsive to determining that the current value of said pitch period is below said minimum or above said maximum for controlling said resetting to be by approximately the number of samples within an integral multiple of said stored pitch period value.

15. Apparatus according to claim 5 including means for controlling the amount of said resetting to be approximately the number of samples in an integral multiple of the last determined pitch period.

16. Apparatus according to claim 12, 14 or 15 wherein the integer for said integral number or multiple is determined as a function of the value of said last determined pitch period or the ratio "C" of pitch change being accomplished or both.

17. Apparatus according to claim 5 wherein the means for determining the pitch period of said audio signals comprises a means for detecting the start of a pitch period and including:

means for summing a predetermined number of consecutive pitch periods; and means for using said sum for controlling said resetting to be by approximately the number of samples within said sum of recent pitch periods.

18. Apparatus according to claim 5 wherein the means for determining the pitch period of said audio signals comprises a means for detecting the start of a pitch period and including:

means for summing one or more consecutive pitch periods;

means for monitoring whether said sum is within predetermined minimum and maximum limits;

updatable storage means for storing a recent value of said sum;

means responsive to determining that said sum is within said limits for restarting said summing means and for storing said sum in said storage means; and means for using the sum currently stored in said storage means for controlling said resetting to be by approximately the number of samples within said sum of recent pitch periods.

19. Apparatus according to any of claims 2 or 5 wherein said second rate is less than said first rate and containing means to control said resetting to take place whenever said writing address location is ahead of said reading address location by more than the number of consecutive samples within the integral number of pitch periods by which the read location is to be advanced in said sequence.

* * * * *